US005261396A

United States Patent [19]

Faulconer et al.

[11] Patent Number: 5,261,396

[45] Date of Patent: Nov. 16, 1993

[54] DIVERS' SNORKEL PURGE RESERVOIR

[75] Inventors: Mark Faulconer, Costa Mesa; Scott Greatrake, San Clemente, both of Calif.

[73] Assignee: U.S. Divers Co., Inc., Santa Ana, Calif.

[21] Appl. No.: 846,869

[22] Filed: Mar. 6, 1992

Related U.S. Application Data

[63] Continuation of Ser. No. 464,379, Jan. 12, 1990, abandoned.

[51] Int. Cl.[5] ..... B63C 11/16

[52] U.S. Cl. ..... 128/201.11; 128/205.24

[58] Field of Search ..... 128/201.11, 205.24, 128/207.16

[56] References Cited

U.S. PATENT DOCUMENTS

| | | | |
|---|---|---|---|
| 2,317,236 | 4/1943 | Wilen et al. | 128/201.11 |
| 2,317,237 | 4/1943 | Wilen | 128/201.11 |
| 3,860,042 | 1/1975 | Green | 128/201.11 |
| 4,655,212 | 4/1987 | Delphia | 128/201.11 |
| 4,834,084 | 5/1989 | Walsh | 128/201.11 |
| 4,860,739 | 8/1989 | Vandepol | 128/201.11 |
| 4,872,453 | 10/1989 | Christianson | 128/201.11 |
| 4,877,022 | 10/1989 | Christianson | 128/201.11 |
| 4,879,995 | 11/1989 | Christianson | 128/201.11 |
| 4,884,564 | 12/1989 | Lamont | 128/201.11 |
| 4,928,710 | 5/1990 | Campbell | 128/201.11 |
| 5,092,324 | 3/1992 | Christianson | 128/201.11 |

*Primary Examiner*—Edgar S. Burr
*Assistant Examiner*—Aaron J. Lewis
*Attorney, Agent, or Firm*—George F. Bethel; Patience K. Bethel

[57] ABSTRACT

The specification discloses a diver's snorkel having an elongated tube with a fitting at the end incorporating a mouthpiece. Distal from the mouthpiece is a water drainage purge chamber extending away from the mouthpiece. The entrance conduit interconnecting the elongated tube to the mouthpiece and the purge chamber is at an angle sloping downwardly from the mouthpiece during use. The purge chamber is angled inwardly toward a diver's chin when in use so that the axis thereof is at an angle to the axis of the mouthpiece. The purge chamber has a purge valve distal from the mouthpiece and incorporates a chamber of significant volume for drainage from the mouthpiece and the elongated tube in an unobstructed manner.

9 Claims, 3 Drawing Sheets

DIVERS' SNORKEL PURGE RESERVOIR

This is a continuation of application Ser. No. 07/464,379 filed Jan. 12, 1990 now abandoned.

BACKGROUND OF THE INVENTION

1. Field of the Invention

The field of this invention lies within the art of diving. More particularly, it lies within the art of diving with the utilization of a snorkel. The utilization of the snorkel can be with or without a self-contained breathing apparatus. The snorkel finds use both for skin diving (i.e. without self-contained breathing apparatus when one swims on the surface and utilizes usually a mask and fins) as well as when one dives to certain depths using self-contained underwater breathing apparatus.

2. The Prior Art

The prior art with respect to snorkels comprises a myriad of breathing apparatus. Generally, they try to accomplish the ability of a diver while swimming on the surface with a snorkel to breath freely and easily without the introduction of water into the mouthpiece.

The introduction of water into the mouthpiece has been a constant problem for divers using snorkels. The prior art has tried to solve it in years' past through various valves and purge systems. Some simple flotation valves used a pingpong type ball and a cage which partially prevented the flow of water into the mouthpiece. Subsequent sophistication provided for purge systems which incorporate the utilization of purge valves. Such purge valves have been utilized at mid-points along the snorkel tube as well as at the ends. In the utilization of such purge valves at the mid-points and ends, it has been common to allow the purge system to use a mushroom type valve or round flapper having a stem. The round flapper with a stem is seated over an open work or grid. When strong exhalation takes place for the purge of water, it drives against the resilience of the purge valve flapper so that it opens and allows the purging of water with the air therefrom.

The utilization of a purge valve has been such wherein it has also been incorporated in separate lateral conduits and bifurcations to allow for the orientation of the purge system in a manner so that it traps water in a presumably optimum manner. Certain purge valve systems have been utilized along a mid-portion of a snorkel conduit.

Recent purge valve systems for snorkels have incorporated a baffle. The baffle usually bifurcates the purge valve conduit from the inlet of the mouthpiece. In doing so, the water is assumed to drain through the purge valve inlet into the purge valve area and be expelled therefrom. The snorkel baffle supposedly eliminates the intake of water into a user's mouth by trying to bifurcate and exclude the water from a user's intake conduit into the mouthpiece. Although this method of elimination of water from a user's mouthpiece for the snorkel has been somewhat successful, it has not provided a snorkel capable of eliminating water in the best possible manner. This is due to the fact that the water tends to sometimes slosh back or become oriented in a manner whereby it is implaced above the baffle toward the mouthpiece. In the alternative it can be of such magnitude due to the nature of the conduit that a user tends to breathe the water inwardly along with the air because the baffle does not protect the inlet to the mouthpiece.

It is believed that the design of this particular purge valve system for a snorkel and its orientation in the preferred embodiments, as well as in the broad conceptual aspects is a significant step over the art. The mouthpiece and purge system have proven to be particularly adaptable and successful in eliminating water from the mouthpiece of the snorkel. Additionally, it has significantly limited the amount of water one breathes in inadvertently by eliminating baffles and making sure there is a clear and unobstructed passage from the main elongated tube of the snorkel toward the mouthpiece. To this end, it eliminates the baffle concept and the various parallel and dual conduits which have been a problem with respect to the utilization of snorkels.

The attendant result is a purge valve system which easily purges water that has entered the snorkel. Also, a substantial capability of breathing is enhanced by the configuration of the unobstructed flow passage of the snorkel, by eliminating baffles and various conduits that have previously been utilized to provide for a purge valve system.

Consequently, it is believed that this invention is a significant step over the art, both from the standpoint of its structural difference, as well as the nature of its operational features thereby providing significant results over that of the prior art.

SUMMARY OF THE INVENTION

In summation, this invention comprises a new and improved snorkel purge valve system incorporating an elongated chamber uniquely offset at an angle from the axis of the mouthpiece and having an introductory conduit for connection to an elongated tube of a snorkel.

More particularly, it incorporates a snorkel having an elongated tube. The elongated tube has an opening at one end for the inlet and outlet of breathing air when it is above the surface of the water. A mouthpiece is provided at the other end that is connected to the elongated tube by means of a fitting. The fitting can be in the form of a connection member incorporating the purge system.

An outlet purge chamber is connected to the mouthpiece in an orientation such that it allows for drainage of water to flow thereinto, rather than the mouthpiece. This is accomplished by creating an elongated chamber having a purge valve at the end of it distal from the mouthpiece. the purge valve at the end of the chamber allows for ejection and purging of water therein that has been drained from either the elongated tube, the inlet connection, or for that matter, the mouthpiece.

In preferable embodiments, the outlet chamber extends from the mouthpiece in a manner whereby it is canted slightly in one direction away from the mouthpiece axis. When in use it is angled toward the chin of a user. The mouthpiece is also such wherein the introductory conduit connected to the elongated tube of the snorkel is canted downwardly slightly away from the mouthpiece so as to provide for drainage away from the mouthpiece into the outlet purge chamber and then through the purge valve.

The entire orientation of the angular relationships of the purge valve chamber, the mouthpiece, and the introductory conduit all provide for superior and improved performance over the prior art. Additionally, the orientation of the respective three elements of the terminal region for breathing through the mouthpiece are such wherein they are functionally different from that seen in the prior art.

BRIEF DESCRIPTION OF THE DRAWINGS

The invention will be more clearly understood by reference to the description below taken in conjunction with the accompanying drawings.

DESCRIPTION OF THE PREFERRED EMBODIMENTS

Figure 1:
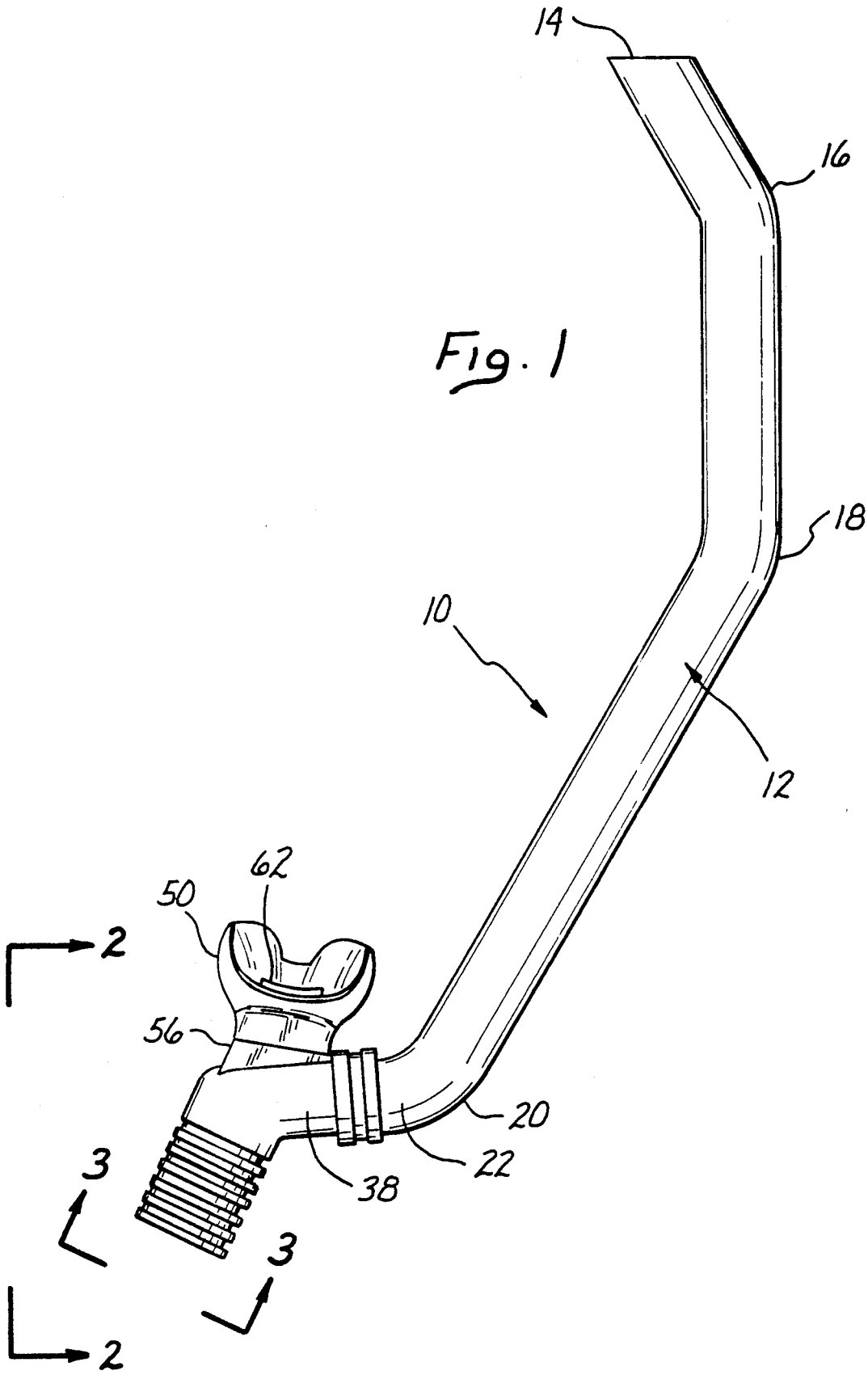
FIG. 1 shows an elevation view of the snorkel of this invention wherein the mouthpiece is shown in an upper position with the purge valve chamber in the lower position which would be a general orientation for usage.
Figure 2:
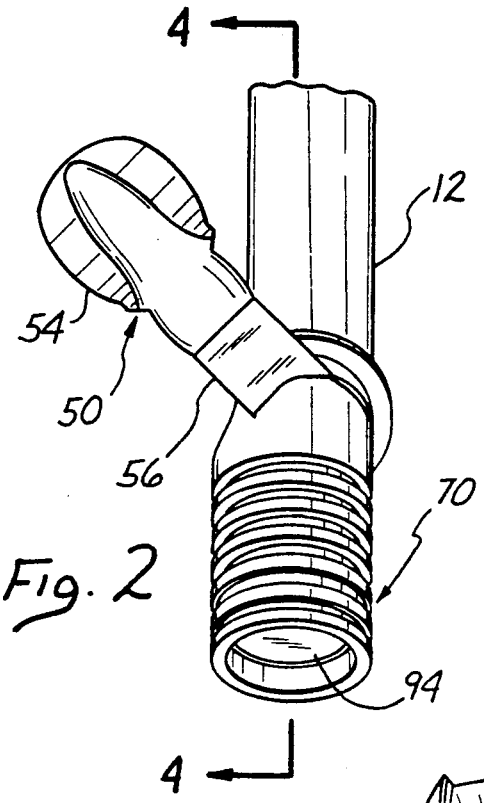
FIG. 2 shows a view of the purge valve and mouthpiece area of the snorkel as seen in the direction of lines 2—2 of FIG. 1.

Looking more particularly at FIG. 1, it can be seen that a snorkel 10 is shown having an elongated tube 12. The elongated tube can be in the form of any particular plastic or elastomeric tubular member having any adaptable cross section. Various tubes can be those that are well known in the art that can be made of such plastics as ABS, polystyrenes, and polymers of different types, including well known plastics in the art having various cross sections such as a circular, rectangular, or triangular cross section.

The elongated tube 12 has a first end 14 which is open. The first end 14 can have a diameter of approximately five eighths of an inch to one and one half inches to be effective. It is believed that this dimension with regard to the diameter of a cross sectionally round snorkel provides sufficient air, while at the same time not overburdening a user with a large tube mass. However, other ranges can be utilized when considering the fact that sufficient air must be brought through the opening 14 to a user.

Generally, the elongated tube 12 is only used when the diver is swimming along the surface and breathing with the tube end opening 14 extended above the water. The first end of the tube opening 14 terminates angularly and bends at a bend 16. It bends again at a second bend 18 and finally, at an L or lower bend 20. At the second end of the snorkel, a second or lower opening 22 is shown. Air passes from the first end opening 14 to the lower or second end opening 22. The intermediate portion such as at the bends 16, 18 and 20 or therebetween, can also have secondary purge means or other connections which are known in the art. The thrust of this invention is toward the lower purge chamber which will be expanded upon hereinafter.

Looking more particularly at the second end or opening 22 of the elongated tube 12, it can be seen that a circular pair of flanges 24 and 26 are shown. These flanges seat within grooves 28 and 30 respectively. The grooves 28 and 30 respectively receive the flanges 24 and 26 so that a tightened connection for the snorkel can be provided therein. At the same time, a rubber gasket or O Ring 32 can be provided in a groove 34 of the elongated tube. This groove 34 allows for the seating of the O Ring 32 therein so that a relatively airtight and watertight passage can be maintained to the connection.

Looking more particularly at the lower portion of the snorkel, a fixture 38 which can be referred to as a connection means, connection conduit, connector, or connection fixture or interconnect from the elongated tube to the mouthpiece, is shown. The connection fixture 38 which is referred to in part as a connection means or conduit incorporates the grooves 28 and 30 which receive the splines or flanges 24 and 26. These grooves 28 and 30 are cast or molded into a relatively hard plastic forming the connection member 38. The connection member 38 can be in the form of any particular plastic but is preferably a plastic formed of a hard thermosetting plastic in order to provide for a substantially nondeformable member to receive the various portions as they are connected. Such plastics can be formed from the family of ABS plastics produced by Dow, such as Dow HX4000 or other such plastics.

The interconnect or connection member 38 has a conduit 40 or passage formed with an inlet 42 and an outlet generally shown as the area 44. The distance from the inlet to the outlet of the inlet conduit 40 can vary. The conduit can be formed in various configurations to receive the passage of air from the elongated tube 12. This passage of air when delivered from the inlet 42 to the outlet 44 can then be delivered to the inlet of a mouthpiece 50. The mouthpiece 50 comprises a mouthpiece portion 52 which receives the teeth of the user and a flange 54 which is received within the lips of a user. The mouthpiece is described within U.S. Pat. No. 4,862,903, as well as U.S. Pat. No. D303,440.

The attachment of the mouthpiece 50 is in the same manner as described in the foregoing patents with a pair of flanges or grooves received on a mouthpiece mounting member, box or air duct 56. The mouthpiece mounting member or duct 56 forms an inner conduit 58 having an inlet 60 and an outlet 62 into a user's mouth. This inlet and outlet respectively 60 and 62 allow for the breathing of air inwardly and outwardly in a manner such that the air received from the outlet 44 of the connection means 38 passes thereinto.

Figure 6:
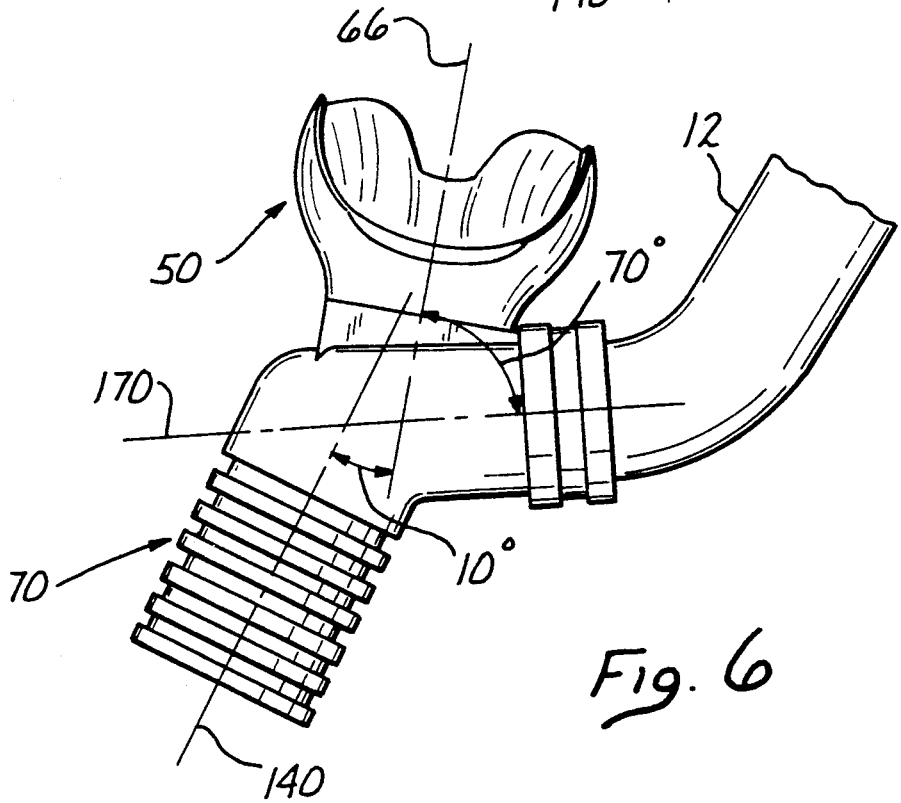
FIG. 6 shows a view similar to FIG. 4 with the axial lines drawn over the figure.

The mouthpiece 50 as seen in FIG. 6 has an axis 66. The axis 66 is in alignment with the axis of the passage through connection, box or conduit 56 having the passage 58 and outlet opening which is connected to the outlet 62 of the mouthpiece 50.

A purge chamber conduit, sump or drain 70 is shown having a plurality of ribs 72 and grooves 74. The ribs and grooves 72 and 74 are used to provide strength but are not necessarily required. They also provide a certain degree of aesthetic quality and can be used as a grip. The purge chamber 74 is formed of a hard plastic and has an inner flange 78 which is received within a groove 80 in a portion of the connection member 38 for ease of assembly and molding.

The purge chamber 74 has an enlarged purge opening or chamber 84 having a volume of anywhere from 0.6 cubic inches to 1.8 cubic inches from the inlet opening area generally defined at edge 88.

The distal end of the purge chamber has a flapper or mushroom valve 94 made of an elastomeric member therein. The mushroom valve 94 has an elastomeric upstanding stem portion 96 that has an enlarged base 98 and a contracted portion 100 for frictionally fitting within an aperture through a web. The web is provided by web members 106 that can be formed as a spandrel going across the end of the purge chamber outlet for support of the elastomeric valve 94. The elastomeric valve has a valve seat 110 against which the peripheral edge of the elastomeric flapper seats. When seating against the valve seat 110, it generally prevents the inlet of water into the purge chamber 84 while at the same time allowing for the purge of water and air therefrom when opened in the direction of purge (arrow P).

Water is generally let into the elongated tube 12 by virtue of the fact that the tube is under water at times and receives a significant amount of water which must be purged. To do this, the water which arrives within the purge chamber 84 receives a sharp blowdown or exhalation pressure in the direction of arrow P. The pressure is from the mouthpiece inlet 60 that creates an air pressure which opens the elastomeric valve 94 off of its seat 110 in the direction of arrow P. This allows the passage of air and the attendant water trapped in the chamber 84 to be blown therefrom.

The chamber is effectively created by not only the depth and the distal relationship it is from the mouthpiece, but also the overall volume which it provides. The prior art mouthpiece purges have not had a discretely enlarged chamber from which water can be blown in a downward manner. Instead, the purges were generally in close proximity to the mouthpiece, thereby allowing the inlet of water. Also, they did not incorporate the angular relationships detailed hereinafter which provides for the superior function of the invention.

Figure 3:
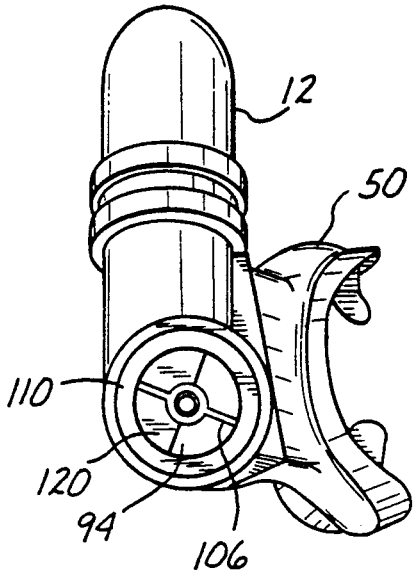
FIG. 3 shows a view of the purge valve and attendant portions surrounding it in the direction of lines 3—3 of FIG. 1.
Figure 4:
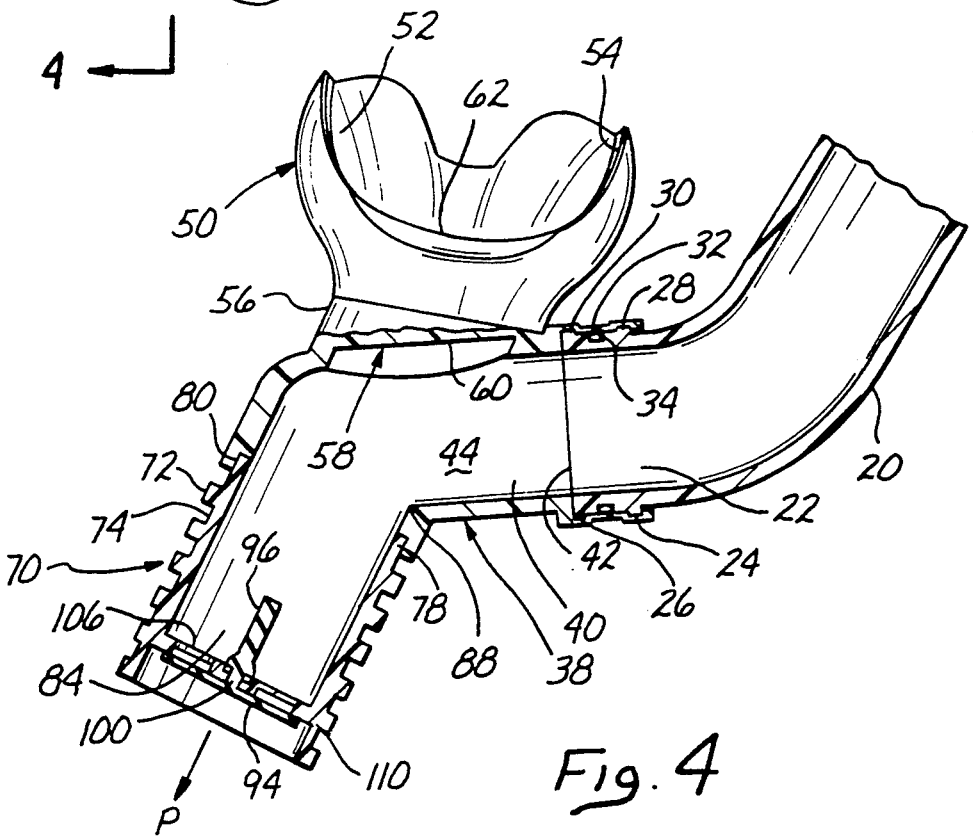
FIG. 4 shows a mid-line sectional view through the purge valve area as seen in the direction of lines 4—4 of FIG. 2.
Figure 5:
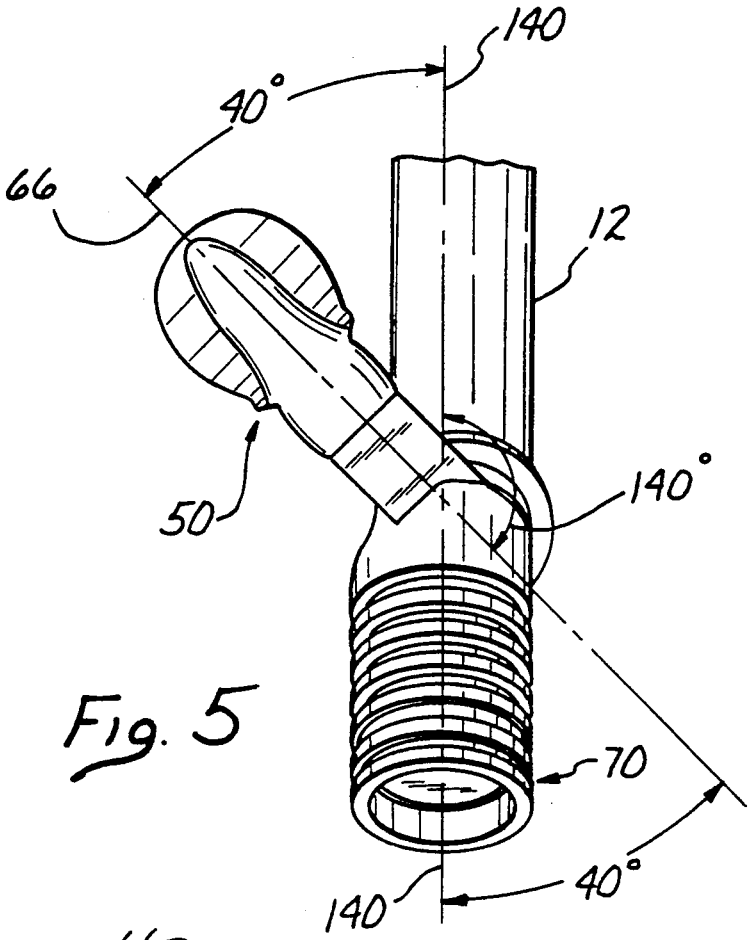
FIG. 5 shows a view similar to FIG. 2, but including center lines or the axis for orienting the invention.

The orientation of the flapper 94 and the webs can be seen more distinctly in FIG. 3 with the flapper 97 removed. The webs 106 can be such wherein they have a partial baffle 120 covering approximately a semicircular area of the purge outlet. This semicircular area of the purge outlet is such where it allows for a stronger pressure to lift the valve member 94 from the seat 110.

It has been found that the orientation of the axes of the mouthpiece 50, purge chamber 70, and inlet connection or conduit 38 are of importance. These general orientations can be oriented with respect to the axis of the mouthpiece, namely axis 66. When referring to lateral or longitudinal relationships with regard to each axis, it is assumed that the mouth of the user when engaging the mouthpiece 50 is holding the mouthpiece along its axis 66 in the orientation of FIG. 1. Starting with this relationship, it can be seen that the axis 66 when the snorkel is in use is directed downwardly and is generally in line with the passage through the center of the connecting box 56 which has a similar axis as axis 66 passing therethrough. These axes are in longitudinal alignment and when extending from the mouth can be defined as longitudinal and when moved to the side are displaced laterally. This axis 66 is in an orientation with regard to the purge chamber 70 and particularly the internal portion of the purge chamber 70. This axis of the purge chamber 70 can be see as axis 140.

Axis 140 or the center line of the symmetrical purge chamber 70 intersects the axis 66 of the mouthpiece and connecting box 56 in a manner whereby the included angle from the axis is forty degrees. In other words, the axis of the mouthpiece 66 is offset longitudinally from the axis of the chamber 70 by forty degrees. This can be seen as the axis extending offset through the elongated tube 12. The angle of the axis 66 and the axis 140 of the chamber between their respective distal ends is one hundred and forty degrees.

It has been found that the relationship of the snorkel is such that the purge chamber 70 should cant backwardly under the diver's chin at approximately forty degrees when in use. However, a substantially excellent operating range would be from thirty to fifty degrees. It has also been found that ranges as high as an angle of sixty degrees toward a user's chin when in use to an angle of twenty degrees in the opposite direction from a user's chin as to the respective axis 66 and 140 is operable. These offsets lie within the offsets of the longitudinal relationship of the axes 66 and 140.

The general ranges of the foregoing angles have been found to be useful particularly in maintaining water within the chamber so that it does not slosh backwardly into a user's mouth, through the mouthpiece opening 60.

In order to provide for a lateral offset which has been found to be helpful, the axis 140 can be offset laterally from axis 66 by approximately ten degrees. However, it has been found that the lateral offset of the chamber 84 can effectively work within a range of zero to thirty degrees. The angle of ten degrees has been shown between the axes 66 and 140 in FIG. 6.

In order to cause the inlet conduit 40 to extend toward the inlet chamber 84, the mouthpiece connection can be canted by twenty degrees such wherein the axis 170 of the inlet connection 38 can be canted so that the result is that it slopes downwardly at approximately twenty degrees. In effect, the axis 66 in relationship to the axis 170 where they intersect results in an included angle of seventy degrees insofar as a lateral offset is concerned. It has been found that this range can be from five to forty-five degrees in order to allow for the sloping and drainage from the inlet connection conduit 40 into the purge chamber 84.

The foregoing ranges of angular orientation are such wherein they can provide and generally function in a manner so that the purge chamber 84 is maintained in a manner whereby it does not cause the inhaling of water in a ready manner from the chamber through the mouthpiece 50 into a user's mouth. The result is that the general angular ranges are such wherein during operating conditions for the snorkel it maintains the purge chamber 70 in a location with respect to the chin and the lateral relationships of the various axes such that it effectively helps to prevent the inhalation of water.

This is not to say that water will not be inhaled when an effective purge has been provided which is completely dry. However, it has been found that within the ranges of prior art operating conditions, the axial configuration, orientation of the distal purge chamber 70 from the mouthpiece opening and the capacity of the purge chamber in consideration of the size of the inlet connection 38 and the elongated tube 12 provide the parameters for relatively substantially improved operation over the prior art.

Accordingly, this invention should be read broadly as to the orientation of the distal purge and the ranges in which the axis of the respective elements of the invention are shown.

We claim:

1. A snorkel for a diver comprising:

an elongated tube having a first opening for the inlet and outlet of breathing air from and to the atmosphere when the first opening is above the surface of the water;

a second opening of said elongated tube for the passage of air to a diver so that the diver can breathe in and out of the elongated tube through said second opening;

a connection member having a first and a second tubular member joined together to form an oblique angle between them and an open end respectively on each tubular member, said first tubular member having a central axis and having a first fitting means on its open end for connection to said second opening of said elongated breathing tube, said second tubular member forming an elongated water drainage outlet purge chamber and having a purge valve closing the open end thereof;

said first tubular member of said connection member having a second fitting substantially overlying said second tubular member for attachment of a mouthpiece; a elastomeric flapper value forming a purge outlet said second tubular member forming said water drainage purge chamber having a central axis and an end which is closed by at least one portion of said elastomeric flapper valve forming a purge outlet so that said purge chamber can serve as a water drainage purge chamber for the storage and exhaust of fluid;

an upwardly opening mouthpiece having a central axis and in connected relationship to said second fitting of said first tubular member by a connection means;

said central axis of said second tubular member forming said purge chamber which extends longitudinally away from said central axis of said mouthpiece to form an included angle within the range of twenty degrees to sixty degrees from said central axis of said purge chamber toward what would be a user's chin when the mouthpiece is inserted within a user's mouth; and, said central axis of said first tubular member intersects said central axis of said mouthpiece such that the included angle between them is within the range of eighty-five degrees to forty-five degrees.

2. The snorkel as claimed in claim 1 wherein:

said central axis of said second tubular member forming said purge chamber extends longitudinally away from said central axis of said mouthpiece in a manner to form an included angle within a range of thirty to fifty degrees toward what would be a user's chin when in use.

3. The snorkel as claimed in claim 1 wherein:

the purge chamber has its central axis displaced laterally from said central axis of said mouthpiece within a range of zero to thirty degrees.

4. The snorkel as claimed in claim 1 wherein:

the volume of the purge chamber is within the range of 0.6 cubic inches to 1.75 cubic inches.

5. A snorkel as claimed in claim 1 wherein said mouthpiece is integrally formed with said connection member.

6. A connector for a snorkel breathing tube to a mouthpiece which is adapted to receive air from a snorkel elongated breathing tube when the elongated tube has a first end opening extending above the surface of the water to allow for the inlet and outlet of air thereinto and wherein a second end opening is connected to said connector for the snorkel mouthpiece such that the connector comprises:

a fitting comprising a first and a second tubular member joined together to form an oblique angle between them and an open end respectively on each tubular member, said first tubular member having a central axis and having a first connection means on its open end for connecting to said second opening of said elongated breathing tube, said second tubular member forming an elongated water drainage outlet purge chamber and having a purge valve closing the open end thereof;

said first tubular member of said fitting having a second connection means substantially overlying said second tubular member for attachment of a mouthpiece; on elastomeric flapper valve comprising a mushroom valve, said second tubular member forming said water drainage purge chamber having a central axis and an opening which is closed by at least one portion of said elastomeric flapper valve forming a purge outlet so that said purge chamber can serve as a water drainage purge chamber for the storage and exhaust of fluid;

an upwardly opening mouthpiece having a central axis and disposed in distal relationship from said purge valve chamber having an opening thereof connected to said second connection means of said first tubular member and having a central axis therein;

wherein said second tubular member forming said purge valve chamber has a central axis which is longitudinally offset from said central axis of said mouthpiece in the direction of a user's chin to form an included angle within the range of twenty to sixty degrees; and, an included angle of the central axis of said first tubular member and said central axis of said mouthpiece is within the range of eighty-five to forty-five degrees.

7. The connector as claimed in claim 6 wherein:

said central axis of said second tubular member forming said purge valve chamber is laterally offset from said central axis of said mouthpiece to form an included angle in the range of zero to thirty degrees.

8. The connector as claimed in claim 6 wherein said flapper valve is seated having a portion of its elastomeric flap seated within the most distal end of said purge valve chamber.

9. The connector as claimed in claim 8 wherein:

the volume of the purge valve chamber is from 0.6 cubic inches to 1.8 cubic inches.

* * * * *